US007588343B1

(12) United States Patent
Carter et al.

(10) Patent No.: US 7,588,343 B1
(45) Date of Patent: Sep. 15, 2009

(54) DECORATIVE BACKLIT STRUCTURAL MEMBERS INCORPORATING GLASS

(76) Inventors: Timothy Boake Carter, 748 Navy St., Santa Monica, CA (US) 90405; Kevin Jinbo, 18275 Santa Fe Ave., Devore Heights, CA (US) 92407

( * ) Notice: Subject to any disclaimer, the term of this patent is extended or adjusted under 35 U.S.C. 154(b) by 962 days.

(21) Appl. No.: 11/049,780

(22) Filed: Feb. 1, 2005

(51) Int. Cl.
*F21V 33/00* (2006.01)

(52) U.S. Cl. ..... 362/152; 362/253; 362/367; 362/431

(58) Field of Classification Search ..... 362/145, 362/152, 153, 153.1, 253, 367, 362, 431
See application file for complete search history.

(56) References Cited

U.S. PATENT DOCUMENTS

| | | | | |
|---|---|---|---|---|
| 1,034,211 | A | 7/1912 | De Palma | |
| 2,721,255 | A | 10/1955 | Lanmon | |
| 4,507,715 | A | 3/1985 | Wedding | |
| 4,674,211 | A | 6/1987 | Pratt | |
| 6,305,826 | B1 * | 10/2001 | Yang | 362/351 |
| 6,505,950 | B1 | 1/2003 | Natoli | |
| 7,036,960 | B1 * | 5/2006 | Gretz | 362/354 |
| 2002/0191391 | A1 * | 12/2002 | Van Etten | 362/153 |
| 2005/0213316 | A1 * | 9/2005 | Inman et al. | 362/152 |

* cited by examiner

*Primary Examiner*—Laura Tso
(74) *Attorney, Agent, or Firm*—Thomas I. Rozsa

(57) ABSTRACT

An improved structural and decorative member which combines a structural member used to provide support to a superstructure such as a roof, a beam etc., includes the use of any type of glass such as clear glass or decorative art or stained glass as part of the support member and has the glass back lit from within the structural member. The concept integrates lighting into outdoor structures such as patio covers, colonnades, balconies and entryways. By making the structure itself the actual lighting source, there is no need to hide the lighting. By illuminating the beauty of stained or art glass which is in the structure, the structure performs the function of the physical support as well as the aesthetic beauty as well as providing a source of lighting to illuminate the area.

38 Claims, 4 Drawing Sheets

DECORATIVE BACKLIT STRUCTURAL MEMBERS INCORPORATING GLASS

BACKGROUND OF THE INVENTION

1. Field of the Invention

The present invention relates to the field of providing lighting for outdoor structures which incorporate the use of the structure to provide both decorative lighting and illumination of the area adjacent the structure.

2. Description of the Prior Art

In general, the incorporation of a lighting element into a physical body has been known. The following prior art references are relevant to the field of the present invention:

1. U.S. Pat. No. 541,337 issued to Sieburg on Jun. 18, 1895 for "Illuminated Column" (hereafter the "Sieburg Patent");
2. U.S. Pat. No. 785,695 issued to Munns on Mar. 21, 1905 for "Column, Pedestal, Or Similar Decorative Architectural Structure" (hereafter the "Munns Patent");
3. U.S. Pat. No. 1,034,211 issued to De Palma on Jul. 30, 1912 for "Illuminated Enameled Metal Barber's Pole" (hereafter the "De Palma Patent");
4. U.S. Pat. No. 2,721,255 issued to Lanmon on Oct. 18, 1955 for "Railing Light" (hereafter the "Lanmon Patent");
5. U.S. Pat. No. 4,507,715 issued to Wedding on Mar. 26, 1985 for "Post Light" (hereafter the "Wedding Patent");
6. U.S. Pat. No. 4,674,211 issued to Pratt on Jun. 23, 1987 for "Frame Structure" (hereafter the "Pratt Patent");
7. U.S. Pat. No. 6,505,950 B1 issued to Natoli on Jan. 14, 2003 for "Lighted Newel Post" (hereafter the "Natoli Patent").

The Sieburg Patent which issued in 1895 discloses the concept of providing illumination through a decorative column but not a structural column. Referring to the first column beginning on Line 40, the Sieburg Patent states:

> "The capital C for the column, extends with its bottom a short distance above the upper edge of the shaft B, as is plainly shown in FIG. 2, and the said capital is supported by an arch D emanating from the entablature E, fastened to a wall or otherwise supported in any suitable manner." Therefore, what this is showing is that the column in Sieburg is not a structural column, but is strictly and solely a decorative column and does not serve any structural purpose."

The Munns Patent discloses a structural column made of translucent rock such as gypsum which has a source of illumination within the stone. A critical difference between the Munns Patent and the present invention is that the Munns column is not illuminated through a glass, but is illuminated through translucent stone so it is not illuminated through any glass or art glass. Further, Munns used the concept of hollowing out stone because he couldn't figure out how to use glass as a structural material.

The De Palma Patent which issued in 1912 discloses an illuminated barber's pole.

The 1955 Lanmon Patent discloses a light that is combined with a railing in a manner such that the light is concealed within the railing but can be used to illuminate portions of the railing. It is also designed to illuminate stairs.

The Wedding Patent is a post light having an upstanding elongate main body portion of decorative appearance, preferably made of concrete and having a hollow interior in which is disposed lengthwise a weather impervious tubular conduit. An annular member is attached on top of the tubular conduit and supports a light bulb socket. This patent discloses the concept of having an elongated porch light illuminated from within.

The Pratt Patent discloses a frame structure for support and display of stained glass artwork that includes a metal structural frame assembly and an opaque reflector panel secured to the rear of the structural metal frame assembly. Specifically, this invention relates to frame structures for mounting works of art and for displaying light transmitting works of art in sheet form such as stained glass and the like.

The Natoli Patent which issued on Jan. 14, 2003 is a lighted newel post. A newel post system contains a light emitting source, such as a halogen and/or fluorescent bulb. The system includes a newel post with a central bore for installing the light source and openings which permit the light to be emitted external of the newel post. A newel post is a bannister at the end of the stairs that is the first heavy column before you go up the railing. The innovation relates to a newel post system for a banister positioned adjacent a stairway comprising a light emitting source, a newel post with a base, said newel post being mounted at said base, said light emitting source located therein, and including at least one opening permitting said light emitting source to provide illumination external to said newel post along said stairway, said newel post having an upper portion having a decorative design, said newel post functioning as part of the banister and a low voltage power source providing electricity to the light emitting source.

While the prior art has disclosed various decorative columns which are illuminated from within, those columns do not provide structural support for a roof or any type of super structure such as a supporting beam. Other prior art has disclosed a supporting structure with illumination but does not include the use of glass as part of the structural support member. There is significant need for an improved structural member incorporating the use of glass which can be illuminated from within.

SUMMARY OF THE INVENTION

The present invention is an improved structural and decorative member which combines a structural member used to provide support to a superstructure such as a roof, a beam etc., includes the use of any type of glass such as clear glass or decorative art or stained glass as part of the support member and has the glass back lit from within the structural member.

The invention relates to the area of the combination of outdoor lighting, art glass design, and a structural column which is used to support a structure, by way of example, a gazebo structure or other outdoor structure or even columns in front of a structure such as a commercial building or residential building.

The concept integrates lighting into outdoor structures such as patio covers, colonnades, balconies and entryways. By making the structure itself the actual lighting source, there is no need to hide the lighting. By illuminating the beauty of stained or art glass which is in the structure, the structure performs the function of the physical support as well as the aesthetic beauty as well as providing a source of lighting to illuminate the area.

The structure can have four columns at four corners or this column can in fact be an entryway column, a balcony etc. The column can be made out of any material but preferably, the column is made out of wood or metal. There is a hollow interior within the column and the hollow portion of the exterior is surrounded by stained glass or other aesthetic art glass. The glass can be on all four sections of the generally square column.

The present invention combines three concepts: outdoor lighting, art glass design, and a structural column. The present invention solves the problem of integrating lighting into outdoor structures such as patio covers, colonnades and entryways. The present invention makes the structure itself the lighting source.

The columns of the present invention are constructed from either wood or metal. One preferred type of wood is balau, an Indonesian hardwood similar to teak in its appearance and color. When made of metal, the columns are preferably constructed from aluminum or steel with powder coated finishes. Other exotic metals such as copper or bronze are used when incorporating water features or for aesthetic appearance. When holding up heavy loads such as second stories or balconies, etc., wood or steel, or a combination of the two are the preferred materials. Less strong materials can be used to support lighter loads such as small balconies, patio canopies, or to light a second story decking. The present invention is also usable with custom gazebos.

It is therefore an object of the present invention to provide a structural support column which has the physical strength to provide structural support and which incorporates glass as part of the support column, combined with an interior source of lighting to back light the glass to thereby provide a source of illumination for the area adjacent the support column and also provide an extremely decorative lighting artwork through the backlit illumination of the column.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
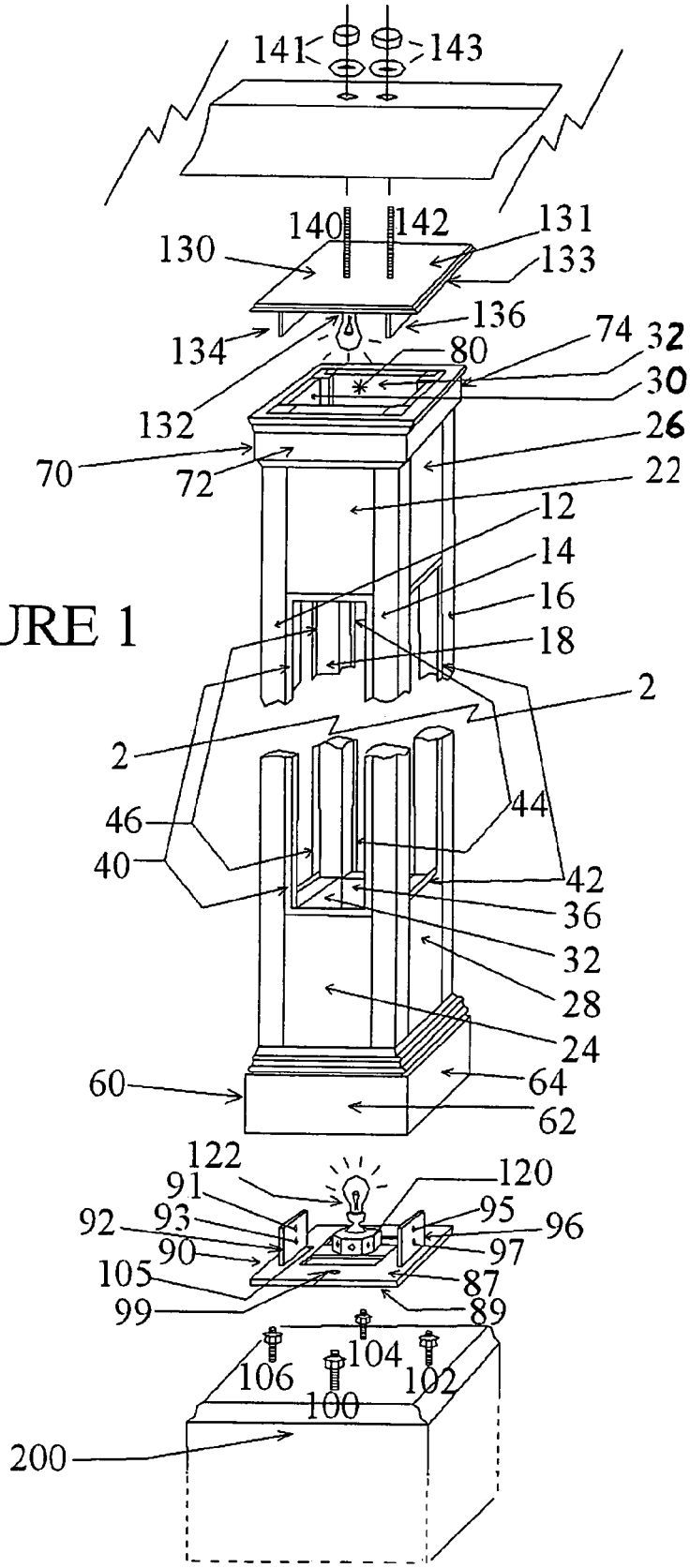
FIG. 1 is an exploded view of a column of the present invention decorative backlit structural member incorporating glass.
Figure 2:
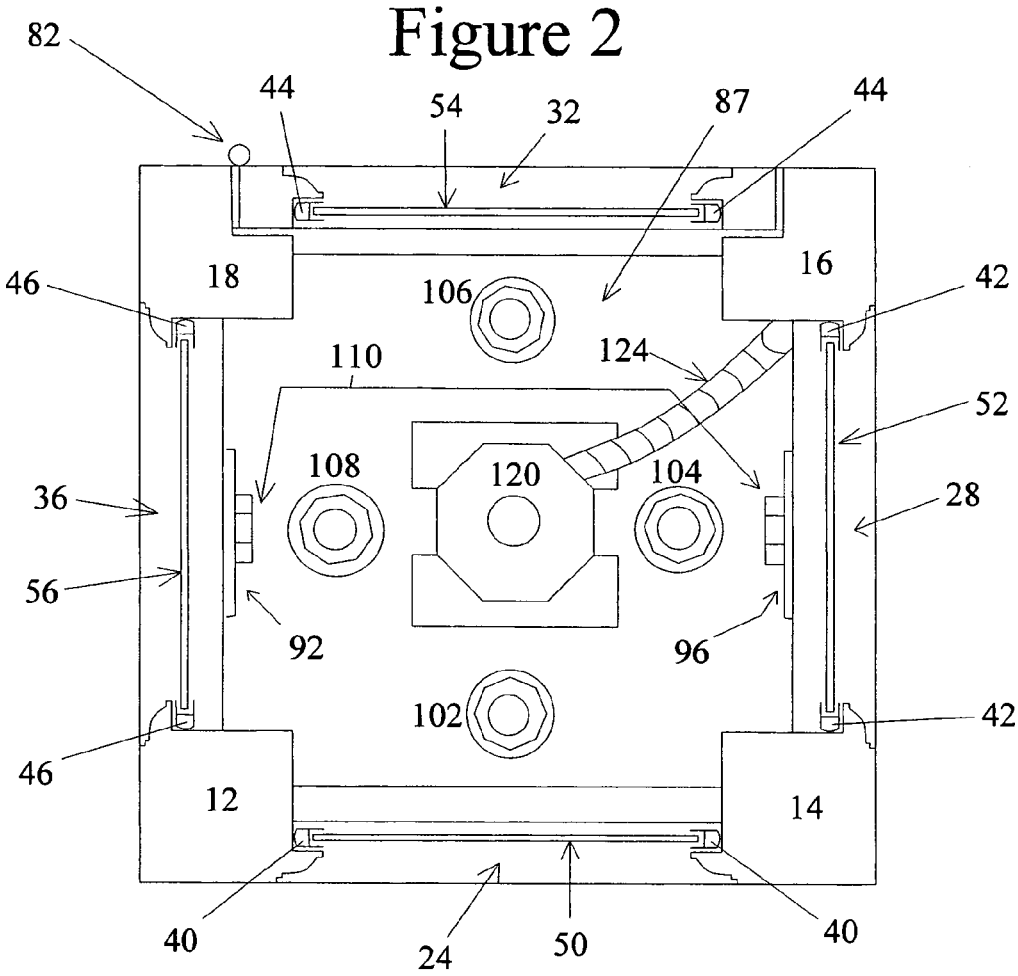
FIG. 2 is a cross-sectional view taken along line 2-2 of FIG. 1.

A support column incorporating the novel features of the present invention is illustrated in detail in the exploded view of FIG. 1 and the cross-sectional view of FIG. 2. The present invention column or structural member 10 includes four spaced apart elongated posts 12, 14, 16 and 18 which in the preferred embodiment form a column of generally square cross-section. Each pair of posts are interconnected adjacent their upper ends by an upper cross-piece and adjacent their lower ends by a lower cross-piece. Posts 12 and 14 are joined by upper cross-piece 22 and lower cross-piece 24. Posts 14 and 16 are joined by upper cross-piece 26 and lower cross-piece 28. Posts 16 and 18 are joined by upper cross-piece 30 and lower cross-piece 32, which cross-pieces also serve as an entry door as will be discussed later. Posts 18 and 12 are joined by upper cross-piece 34 and lower cross-piece 36.

In one embodiment, a pair of elongated posts and a pair of upper and lower cross-pieces serve as a frame to support a panel of glass. In an alternative embodiment as illustrated in FIG. 1, the pair of elongated posts and the pair of upper and lower cross-pieces serve as an exterior frame support to support an interior frame which in turn supports a panel of glass.

Referring to FIGS. 1 and 2, elongated posts 12 and 14 and upper cross-piece 22 and lower cross-piece 24 provide exterior frame support for glass frame 40, which frame supports and holds a panel of glass 50. Elongated posts 14 and 16 and upper cross-piece 26 and lower cross-piece 28 provide exterior frame support for glass frame 42, which frame supports and holds a panel of glass 52. Elongated posts 16 and 18 and upper cross-piece 30 and lower cross-piece provide exterior frame support for glass frame 44, which frame supports and holds a panel of glass 54. Elongated posts 18 and 12 and upper cross-piece 34 and lower cross-piece 36 provide exterior frame support for glass frame 46, which frame supports and holds a panel of glass 56.

The four elongated posts 12, 14, 16 and 18 and four lower cross-pieces 24, 28, 32 and 36 are connected at their lower ends to a lower base molding 60 having four sides, a first side 62, and second side 64 perpendicular to first side 62, a third side (not shown) parallel to first side 62 and a fourth side (not shown) parallel to second side 64. The four elongated posts 12, 14, 16 and and the four upper cross-pieces 22, 26, 30 and 34 are connected at their upper ends to an upper crown molding 70 having four sides, a first side 72, and a second side 74 perpendicular to first side 72, a third side (not shown) parallel to first side 72 and a fourth side (not shown) parallel to second side 74.

The four elongated posts 12, 14, 16 and 18, the four upper and lower cross-pieces 22, 24, 26, 28, 30, 32, 34 and 36, the four frames 40, 42, 44 and 46, the four glass panels 50, 52, 54 and 50, the lower base molding and its four sides and the upper crown molding 70 and its four sides surround and form a hollow interior chamber 80. To gain access to the hollow interior chamber 80 one of four sides comprising the upper and lower cross-pieces frame and glass panel are formed in the hinged door which can be rotatably opened. By way of example only, cross-pieces 31 and 34 and frame 44 and glass panel 46 are hingeably attached along one side by hinge 82 to form a door which can be rotated open to gain access to chamber 80.

The entire assembly is supported on a leveling base plate 90 which by way of example, can be made of ¼ inch steel. The base plate 90 supports a pair of oppositely disposed brackets, a first bracket 92 having a pair of spaced apart openings 91 and 93 and a parallel oppositely disposed second bracket 96 having a pair of spaced apart openings 95 and 97. The base plate also comprises four openings spaced 90 degrees apart of which two openings 99 and 105 are illustrated in FIG. 1. Four separate anchor bolts 100, 102, 104 and 106, each having washers and nuts attached, are respectively placed through each of the respective openings in base plate 90. The bolt and its washer are placed through the upper surface 87 of base plate 90 and respectively secured with a nut threaded onto the bolt and resting adjacent the lower surface 89 of base plate 90.

To install a column, a deep support pier 200 which, by way of example can be a concrete pouring which is 24" by 24" by 18" deep, is formed with the four anchor bolts 100, 102, 104 and 102 protruding. The ultimate height of the column can be extended by forming a pier at a greater height above grade with concrete, brick stone, etc. Nuts and washers are first fastened to the anchor bolts and the column set on top and leveled by adjusting the heights of the nuts. Once it is adjusted for height and leveled, a dry mix of mortar is packed under the base plate 90 to insure stability. The lower base molding 60 is then pulled down and over the base plate 90 and secured by securing bolts extending through the openings in the brackets 92 and 94. Referring to FIG. 2, one securing bolt 108 is shown extending through first bracket 92 and one securing bolt 110 is shown extending through second bracket 96. The base molding 60 can also additionally be secured to the base plate 90 with finish nails if the column is made of wood or in the case of metal columns, secured with screws from inside the column. Caulking the top seam of the base molding with a clear silicone after finishing is required to prevent water from seeping behind the molding.

The base 90 also supports a lower light fixture 120 on its upper surface 87. The electrical lower light fixture 120 can be for either a 110 volt or low voltage light bulb 122. The fixture 120 can support at least one bulb or any multiplicity of bulbs. A conduit 124 encloses electrical wiring which extends up through the column and ties into an identical fixture (which will be discussed) on the top inside enabling the lighting to emanate simultaneously from the top and bottom of the column.

The upper portion of column supports a top plate 130 having an upper surface 131 and a lower surface 133. An electrical fixture identical to fixture 120 is supported on the lower surface of top plate 130. A pair of brackets 134 and 136 supported on the lower surface 133 of top plate 130 enable top plate 130 to be secured to the upper crown molding 70 through bolts in a manner comparable to the way the lower base plate 90 was secured to the lower base molding 60. As illustrated in FIG. 1, the bulb 122 of lower electrical light fixture extends upwards onto a hollow chamber 80 and the bulb 132 extends downwardly into hollow chamber 80. The wiring from the lower electrical fixture 120 extends up through the column formed by the posts, cross-pieces and glass plates and ties into the identical light fixture on the top inside enabling the lighting to simultaneously emanate from the top and bottom of the column. The wiring is then connected to a source of power. Both electrical fixtures can be 110 volt fixtures or low voltage fixtures and house at least one bulb.

The bulb 122 of the bottom fixture 120 is below the bottom of glass panels 50, 52, 54 and and the bulb 132 of the top fixture is above the top of the glass panels 50, 52, 54 and 56 so as to keep all fields of glass clear in the event the glass panels are made of translucent glass to thereby avoid shadowed images or visible light bulbs in the visual field of glass. It also enables the glass panels to be backlit. If the glass panels are made of crystal or stained glass, the visual effect is beautiful and stunning.

The top plate 130 can also be made of ¼ inch steel and serves a similar function to the base plate 90 in that it has brackets that bolt to the rails of the column and support the top lighting fixture. The top plate 130 also serves as a roof cap to keep weather out and has a decorative drip edge 133 that diverts rain from the top molding or upper crown molding 70 of the column. In addition, the top plate 130 serves as a load distribution for the joint or load bearing beams to spread the load to the four outer posts 12, 14, 16 and 18 of the column.

One structural beam or joint 300 is illustrated in FIG. 1. The structural beam 300 is bolted to top plate 130 by threaded rods 140 and 142 and secured thereto by nuts and washers, illustrated at 141 for rod 140 and 143 for rod 142.

The column or structural member 10 can support extremely heavy loads due to the close proximity (roughly of 14 inch square) of four closely grouped posts and are engineered for the type of material used to construct the column and the load it must carry. It can in virtually all cases support anything any other structurally engineered column can achieve.

Figure 3:
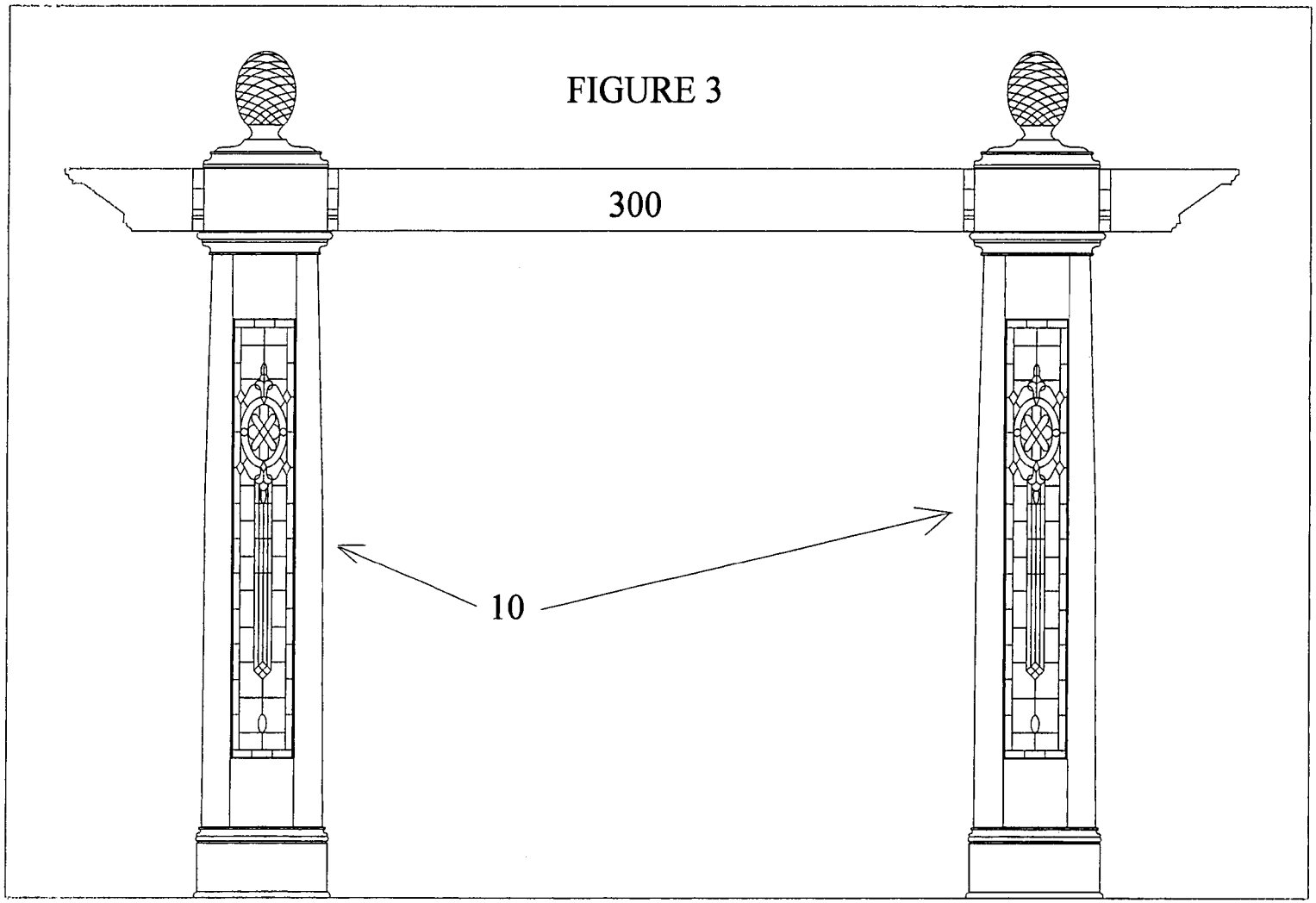
FIG. 3 is a side elevational view of two adjacent columns of the present invention supporting a beam.
Figure 4:
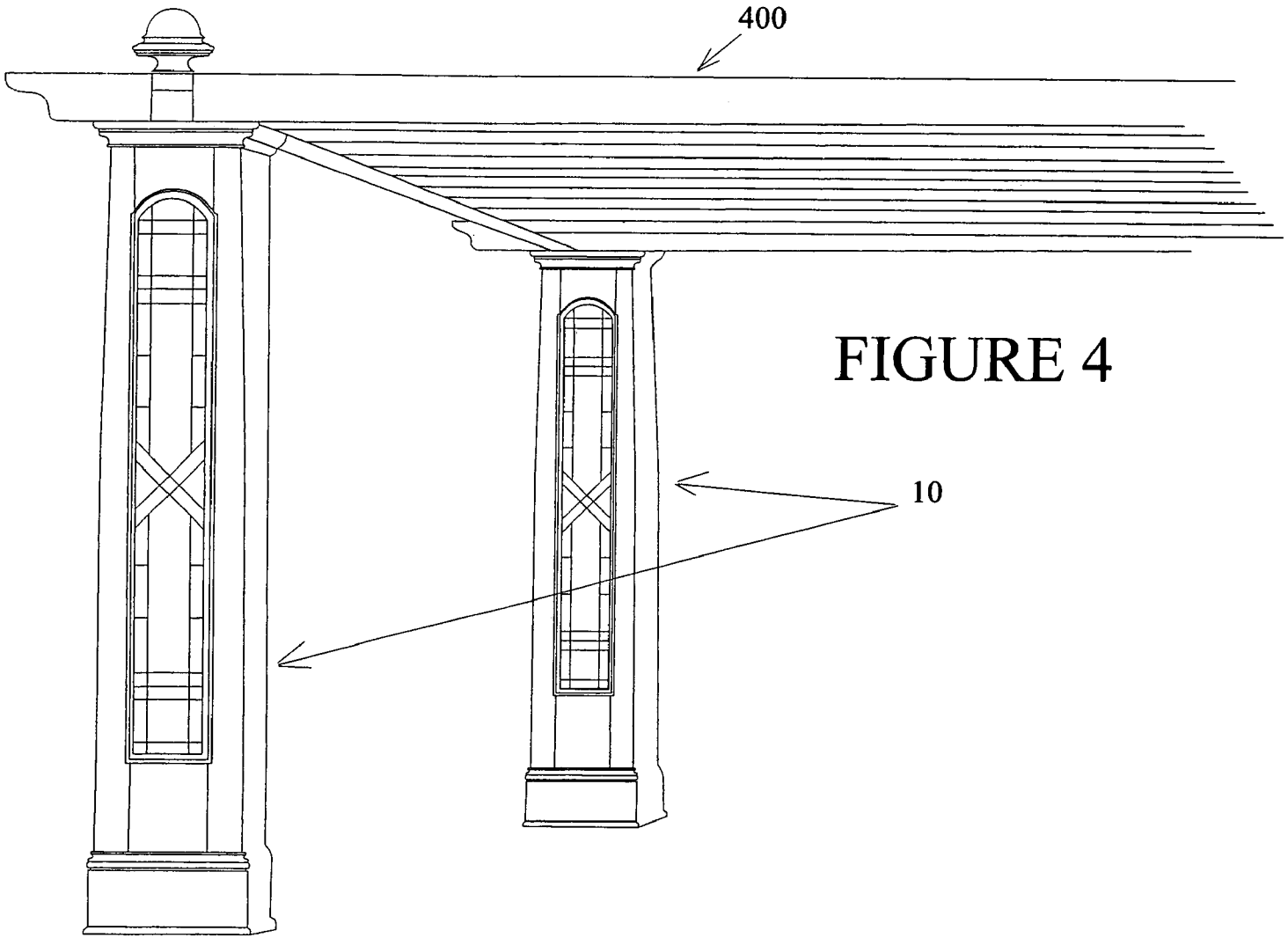
FIG. 4 is a perspective view of two adjacent columns of the present invention supporting a portion of a gazebo.

The present invention incorporated as a decorative backlit structural member incorporating glass is illustrated in FIGS. 3 and 4. In FIG. 3, two columns 10 of the present invention are used to support a structural beam 300 of a patio, balcony or other structural member of any type of building, whether it be a private residence, an apartment, an office building or any other type of commercial building. The column 10 can also be an interior structural column.

Referring to FIG. 4, the present invention columns 10 are used to support patio cover Therefore, the novel feature of the present invention is that it combines a structural support member made out of wood or metal that incorporates glass as part of the structural member and that is backlit from within through lighting means that cannot be seen but that back light the glass to produce a beautiful visual aesthetic effect in addition to providing a source of lighting to illuminate the area adjacent the column 10.

The glass designs are chosen to fit the architectural style of the surrounding architecture. The finished product is designed to appear as an internally lit stained glass sculpture that can serve a structural function of virtually any type. The structure of the stained glass light column 10 can be constructed of either a combination of wood and metal or all metal. As its combined purpose is that of a structural column and a decorative lighting source emanating through the prism of four stained glass art panels, the structural load is carried by the four perimeter posts leaving what traditionally would be filled with wood or metal panels open for the glass panels.

Defined in detail, the present invention is a decorative structural column, comprising: (a) a first elongated post, a second elongated post, a third elongated post, a fourth elongated post, the four posts being spaced apart and parallel to each other to form a generally square structure, the first and second post being in the same plane, the second and third posts being in the same plane, the third and fourth posts being in the same plane and the fourth and first posts being in the same plane; (b) a first upper cross-piece adjacent a top section of and interconnecting the first and second posts and a parallel spaced apart first lower cross-piece adjacent a bottom section of and interconnecting the first and second posts, a second upper cross-piece adjacent a top section of and interconnecting the second and third posts and a parallel spaced apart second lower cross-piece adjacent a bottom section of interconnecting the second and third posts, a third upper cross-piece adjacent a top section of and interconnecting the third and fourth posts and a parallel spaced apart third lower cross-piece adjacent a bottom section of and interconnecting the third and fourth posts, and a fourth upper cross-piece adjacent a top section of and interconnecting the fourth and first posts and a parallel spaced apart fourth lower cross-piece adjacent a bottom section of and interconnecting the fourth and first posts; (c) a first frame supported by the first and second posts of the first upper and lower cross-pieces, a first glass panel supported in the first frame, a second frame supported by the second and third posts and the second upper and lower cross-pieces, a second glass panel supported in the second framed, a third frame supported by the third and fourth posts and the third upper and lower cross-pieces, a third glass panel supported in the third framed, and a fourth frame supported by the fourth and first posts and the fourth upper and lower cross-pieces, a fourth glass panel supported in the fourth frame; (d) a lower base molding attached to the bottom ends of the four posts and the four lower cross-pieces and an upper crown molding attached to the top ends of the four posts and the four upper cross-pieces, the four posts, four upper cross-pieces, four lower cross-pieces, four frames and their respective glass panels, the lower base molding and the upper crown molding forming a column with a hollow interior; (e) a lower base plate having an upper surface on which is supported a pair of oppositely disposed connecting brackets by which the lower base plate is connected to the lower base molding, the lower base plate supporting a lower electrical fixture with at least one bulb extending upwardly therefrom, the lower base plate having a multiplicity of openings to enable a respective one of a multiplicity of connecting bolts to respectively extend through a respective opening and be mounted in a support pier; (f) a top plate having a lower surface on which is supported a pair of oppositely disposed connecting brackets by which the top plate is connected to the upper crown molding, the top plate supporting an upper electrical fixture with at least one bulb extending downwardly therefrom, the upper base plate having a multiplicity of openings by which connecting means attach the top plate to the beam of a structure; (g) wiring means extending through the column and interconnecting the lower electrical fixture and the upper electrical fixture and connected to a source of power;

(h) the at least one bulb of the lower electrical fixture extending below the level of the glass panels and the at least one bulb of the upper electrical extending above the level of the glass panels, so that the bulbs are not visible through the glass panels; and (i) the posts and cross-pieces and bases form a column which acts as a structural member to support a structure while the at least one bulb of the lower and upper electrical fixtures provide backlighting through the column whereby the glass panels are illuminated to create aesthetic beauty and illumination in the area surrounding the column.

Defined broadly, the present invention is a decorative structural column, comprising: (a) four elongated spaced apart posts which are spaced apart from and parallel to each other to form the support posts of a column; (b) interconnecting upper and lower cross-piece members with a respective pair of upper and lower cross-piece members being parallel to and spaced apart from each other and interconnecting a respective pair of elongated posts so that an opening 15 formed between the interior of each of two respective posts and between the upper and lower cross-piece joined to that pair of posts; (c) a glass panel supported in each opening formed by a pair of posts and its respective joining upper and lower cross-pieces; (d) a lower base molding attached to the bottom of each of the four posts and the four lower cross-pieces and an upper crown molding attached to the top ends of the four posts and the four upper cross-pieces, the four posts, four upper cross-pieces, four lower cross-pieces, four glass panels, the lower base molding and the upper crown molding forming a column with a hollow interior; (e) a lower base plate having means to attach the lower base plate to the lower base molding, the lower base plate supporting a lower electrical fixture with at least one bulb extending upwardly therefrom, the lower base plate having means to anchor the lower base plate to a foundation; (f) a top plate having means to attach the top plate to the upper crown molding, the top base plate supporting an upper electrical fixture with at least one bulb extending downwardly therefrom, the top plate having means to attach the top plate to the beam of a structure; (g) wiring means extending through the column and interconnecting the lower electrical fixture and the upper electrical fixture and connected to a source of power; (h) the at least one bulb of the lower electrical fixture extending below the level of the glass panels and the at least one bulb of the upper electrical fixture extending above the level of the glass panel, so that the bulbs are not visible through the glass panels; and (i) the posts, cross-pieces and base form a column which acts as a structural member to support a structure which the at least one bulb of the lower and upper electrical fixture provides backlighting through the column whereby the glass panels are illuminated to create aesthetic beauty and illumination in the area surrounding the column.

Defined more broadly, the present invention is a decorative structural column, comprising: (a) a multiplicity of spaced apart posts which are spaced apart from and parallel to each other to form the posts of a column; (b) at least one of a pair of adjacent posts having interconnecting means to interconnect the posts adjacent their upper ends and adjacent their lower ends so that an opening is formed between the interior of the two posts and between the interconnecting means, the remaining sets of posts being at least interconnected to form a column having a hollow interior; (c) at least one glass panel which is supported in the opening between two posts and their interconnecting means; (d) a lower base plate having means to attach the lower base plate adjacent the lower end of the column, the lower base plate supporting a lower electrical fixture with at least one bulb extending upwardly therefrom, the lower base plate having means to anchor the lower base plate to a foundation; (e) a top plate having means to attach the top plate adjacent the upper end of the column, the top plate supporting an upper electrical fixture with at least one bulb extending downwardly therefrom, the top plate having means to attach the top plate to the beam of a structure; (f) wiring members extending through the column and interconnecting the lower electrical fixture and the upper electrical fixture and connected to a source of power; (g) the at least one bulb of the lower electrical fixture extending below the level of the glass panel and the at least one bulb of the upper electrical fixture extending above the level of the glass panel, so that the bulb is not visible through the glass panel; and (h) the posts and the interconnecting means form a column which acts as a structural member to support a structure while the at least one bulb of the lower and upper electrical fixtures provide backlighting through the column wherein the glass panel is illuminated to create aesthetic beauty and illumination in the area surrounding the column.

Defined even more broadly, the present invention is a decorative structural column, comprising: (a) a multiplicity of spaced apart posts which are spaced apart from and parallel to each other to form the posts of a column; (b) at least one of a pair of adjacent posts having interconnecting means to interconnect the post with an opening formed between the interior of the posts and within the interconnecting means, the remaining sets of posts being at least interconnected to form a column having a hollow interior; (c) at least one glass panel which is supported in the opening between two posts and their interconnecting means; (d) a lower base plate having means to attach the lower base plate adjacent the lower end of the column, the lower base plate having means to anchor the lower base plate to a foundation; (e) a top plate having means to attach the top plate adjacent the upper end of the column, the top plate having means to attach the top plate to the beam of a structure; (f) at least one electrical fixture supported on either the lower base plate or the top plate, with the at least one electrical fixture having a source of light which extends into the hollow interior of the column by a distance so that the source of light is not visible through the glass panel, and wiring means to connect the electrical fixture to a source of power; and (g) the posts and interconnecting means form a column which acts as a structural member to support a structure while the light source from the at least one electrical fixture provides backlighting through the column wherein the glass panel is illuminated to create aesthetic beauty and illuminate the area surrounding the column.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A decorative structural column, comprising:

a. a first elongated post, a second elongated post, a third elongated post, a fourth elongated post, the four posts being spaced apart and parallel to each other to form a generally square structure, the first and second post being in the same plane, the second and third posts being in the same plane, the third and fourth posts being in the same plane and the fourth and first posts being in the same plane;

b. a first upper cross-piece adjacent a top section of and interconnecting the first and second posts and a parallel spaced apart first lower cross-piece adjacent a bottom section of and interconnecting the first and second posts, a second upper cross-piece adjacent a top section of and interconnecting the second and third posts and a parallel spaced apart second lower cross-piece adjacent a bottom section of interconnecting the second and third posts, a third upper cross-piece adjacent a top section of and interconnecting the third and fourth posts and a parallel spaced apart third lower cross-piece adjacent a bottom section of and interconnecting the third and fourth posts, and a fourth upper cross-piece adjacent a top section of and interconnecting the fourth and first posts and a parallel spaced apart fourth lower cross-piece adjacent a bottom section of and interconnecting the fourth and first posts;

c. a first frame supported by said first and second posts of said first upper and lower cross-pieces, a first glass panel supported in the first frame, a second frame supported by said second and third posts and said second upper and lower cross-pieces, a second glass panel supported in said second framed, a third frame supported by said third and fourth posts and said third upper and lower cross-pieces, a third glass panel supported in said third framed, and a fourth frame supported by said fourth and first posts and said fourth upper and lower cross-pieces, a fourth glass panel supported in the fourth frame;

d. a lower base molding attached to the bottom ends of the four posts and the four lower cross-pieces and an upper crown molding attached to the top ends of the four posts and the four upper cross-pieces, the four posts, four upper cross-pieces, four lower cross-pieces, four frames and their respective glass panels, the lower base molding and the upper crown molding forming a column with a hollow interior;

e. a lower base plate having an upper surface on which is supported a pair of oppositely disposed connecting brackets by which the lower base plate is connected to the lower base molding, the lower base plate supporting a lower electrical fixture with at least one bulb extending upwardly therefrom, the lower base plate having a multiplicity of openings to enable a respective one of a multiplicity of connecting bolts to respectively extend through a respective opening and be mounted in a support pier;

f. a top plate having a lower surface on which is supported a pair of oppositely disposed connecting brackets by which the top plate is connected to the upper crown molding, the top plate supporting an upper electrical fixture with at least one bulb extending downwardly therefrom, the upper base plate having a multiplicity of openings by which connecting means attach the top plate to the beam of a structure;

g. wiring means extending through the column and interconnecting the lower electrical fixture and the upper electrical fixture and connected to a source of power;

h. the at least one bulb of the lower electrical fixture extending below the level of the glass panels and the at least one bulb of the upper electrical extending above the level of the glass panels, so that the bulbs are not visible through the glass panels; and i. the posts and cross-pieces and bases form a column which acts as a structural member to support a structure while the at least one bulb of the lower and upper electrical fixtures provide backlighting through the column whereby the glass panels are illuminated to create aesthetic beauty and illumination in the area surrounding the column.

2. The invention in accordance with claim 1, wherein said four glass panels are made of stained glass.

3. The invention in accordance with claim 1, wherein said four glass panels are made of clear glass.

4. The invention in accordance with claim 1, wherein one of said combination of cross-pieces, frame and glass panels are hingeably attached to a post so that it forms a door to gain access to the interior of said columns.

5. The invention in accordance with claim 1, wherein said four posts, said eight cross-pieces, and said upper and lower molding are made of wood.

6. The invention in accordance with claim 1, wherein said four posts, said eight cross-pieces and said upper and lower molding are made of metal.

7. The invention in accordance with claim 1, wherein said lower electrical fixtures and said upper electrical fixture are 110 volt fixtures.

8. The invention in accordance with claim 1, wherein said lower electrical fixture and said upper electrical fixtures are low voltage lighting.

9. A decorative structural column, comprising:

a. four elongated spaced apart posts which are spaced apart from and parallel to each other to form the support posts of a column;

b. interconnecting upper and lower cross-piece members with a respective pair of upper and lower cross-piece members being parallel to and spaced apart from each other and interconnecting a respective pair of elongated posts so that an opening formed between the interior of each of two respective posts and between the upper and lower cross-piece joined to that pair of posts;

c. a glass panel supported in each opening formed by a pair of posts and its respective joining upper and lower cross-pieces;

d. a lower base molding attached to the bottom of each of the four posts and the four lower cross-pieces and an upper crown molding attached to the top ends of the four posts and the four upper cross-pieces, the four posts, four upper cross-pieces, four lower cross-pieces, four glass panels, the lower base molding and the upper crown molding forming a column with a hollow interior;

e. a lower base plate having means to attach the lower base plate to said lower base molding, the lower base plate supporting a lower electrical fixture with at least one bulb extending upwardly therefrom, the lower base plate having means to anchor the lower base plate to a foundation;

f. a top plate having means to attach the top plate to said upper crown molding, the top base plate supporting an upper electrical fixture with at least one bulb extending downwardly therefrom, the top plate having means to attach the top plate to the beam of a structure;

g. wiring means extending through the column and interconnecting the lower electrical fixture and the upper electrical fixture and connected to a source of power;

h. the at least one bulb of the lower electrical fixture extending below the level of the glass panels and the at least one bulb of the upper electrical fixture extending above the level of the glass panel, so that the bulbs are not visible through the glass panels; and i. the posts, cross-pieces and base form a column which acts as a structural member to support a structure which the at least one bulb of the lower and upper electrical fixture provides backlighting through the column whereby the glass panels are illuminated to create aesthetic beauty and illumination in the area surrounding the column.

10. The invention in accordance with claim 9, further comprising a frame supported in each open space bounded by the interior of two adjacent posts and their respective interconnecting upper and lower cross-pieces, each respective glass panel supported in a respective frame.

11. The invention in accordance with claim 9, wherein the four glass panels are made of clear glass.

12. The invention in accordance with claim 9, wherein the four glass panels are made of stained glass.

13. The invention in accordance with claim 9, wherein one of said combination of cross-pieces, frame and glass panels are hingeably attached to a post so that it forms a door to gain access to the interior of said column.

14. The invention in accordance with claim 9, wherein said four posts, said eight cross-pieces, and said upper and lower molding are made of wood.

15. The invention in accordance with claim 9, wherein said four posts, said eight cross-pieces and said upper and lower molding are made of metal.

16. The invention in accordance with claim 9, wherein said lower electrical fixtures and said upper electrical fixture are 110 volt fixtures.

17. The invention in accordance with claim 9, wherein said lower electrical fixture and said upper electrical fixtures are low voltage lighting.

18. A decorative structural column, comprising:

a. a multiplicity of spaced apart posts which are spaced apart from and parallel to each other to form the posts of a column;

b. at least one of a pair of adjacent posts having interconnecting means to interconnect the posts adjacent their upper ends and adjacent their lower ends so that an opening is formed between the interior of the two posts and between the interconnecting means, the remaining sets of posts being at least interconnected to form a column having a hollow interior;

c. at least one glass panel which is supported in said opening between two posts and their interconnecting means;

d. a lower base plate having means to attach the lower base plate adjacent the lower end of said column, the lower base plate supporting a lower electrical fixture with at least one bulb extending upwardly therefrom, the lower base plate having means to anchor the lower base plate to a foundation;

e. a top plate having means to attach the top plate adjacent the upper end of said column, the top plate supporting an upper electrical fixture with at least one bulb extending downwardly therefrom, the top plate having means to attach the top plate to the beam of a structure;

f. wiring members extending through the column and interconnecting the lower electrical fixture and the upper electrical fixture and connected to a source of power;

g. the at least one bulb of the lower electrical fixture extending below the level of the glass panel and the at least one bulb of the upper electrical fixture extending above the level of the glass panel, so that the bulb is not visible through the glass panel; and h. the posts and the interconnecting means form a column which acts as a structural member to support a structure while the at least one bulb of the lower and upper electrical fixtures provide backlighting through the column wherein the glass panel is illuminated to create aesthetic beauty and illumination in the area surrounding the column.

19. The invention in accordance with claim 18, further comprising a lower base molding attached adjacent the lower ends of the posts and to which the lower base plate is attached.

20. The invention in accordance with claim 18, further comprising an upper crown molding attached adjacent the upper ends of the posts and to which the top plate is attached.

21. The invention in accordance with claim 18, further comprising a frame supported in said opening, the glass panel suspended in said frame.

22. The invention in accordance with claim 18, wherein a door is formed into the column between the adjacent posts so that access can be gained to the interior of the column.

23. The invention in accordance with claim 18, wherein said glass panel is clear glass.

24. The invention in accordance with claim 18, wherein said glass panel is stained glass.

25. The invention in accordance with claim 18, wherein said posts are made of wood.

26. The invention in accordance with claim 18, wherein said posts are made of metal.

27. The invention in accordance with claim 18, wherein said electrical fixtures are low voltage fixtures.

28. A decorative structural column, comprising:

a. a multiplicity of spaced apart posts which are spaced apart from and parallel to each other to form the posts of a column;

b. at least one of a pair of adjacent posts having interconnecting means to interconnect the post with an opening formed between the interior of the posts and within the interconnecting means, the remaining sets of posts being at least interconnected to form a column having a hollow interior;

c. at least one glass panel which is supported in said opening between two posts and their interconnecting means;

d. a lower base plate having means to attach the lower base plate adjacent the lower end of said column, the lower base plate having means to anchor the lower base plate to a foundation;

e. a top plate having means to attach the top plate adjacent the upper end of said column, the top plate having means to attach the top plate to the beam of a structure;

f. at least one electrical fixture supported on either the lower base plate or the top plate, with the at least one electrical fixture having a source of light which extends into the hollow interior of the column by a distance so that the source of light is not visible through said glass panel, and wiring means to connect the electrical fixture to a source of power; and g. the posts and interconnecting means form a column which acts as a structural member to support a structure while the light source from the at least one electrical fixture provides backlighting through the column wherein the glass panel is illuminated to create aesthetic beauty and illuminate the area surrounding the column.

29. The invention in accordance with claim 28, further comprising a lower base molding attached adjacent the lower ends of the posts and to which the lower base plate is attached.

30. The invention in accordance with claim 28, further comprising an upper crown molding attached adjacent the upper ends of the posts and to which the top plate is attached.

31. The invention in accordance with claim 28, further comprising a frame supported in said opening, the glass panel supported in said frame.

32. The invention ins accordance with claim 28, wherein a door is formed into the column between two adjacent posts so that access can be gained to the interior of the column.

33. The invention in accordance with claim 28, wherein said glass panel is clear glass.

34. The invention in accordance with claim 28, wherein said glass panel is stained glass.

35. The invention in accordance with claim 28, wherein said posts are made of wood.

36. The invention in accordance with claim 28, wherein said posts are made of metal.

37. The invention in accordance with claim 28, wherein said electrical fixtures are 110 volt fixtures.

38. The invention in accordance with claim 28, wherein said electrical fixtures are low voltage fixtures.

* * * * *